United States Patent [19]

Gillette

[11] 3,950,144

[45] Apr. 13, 1976

[54] COAL PROCESSING SYSTEM

[75] Inventor: Robert P. Gillette, Randolph, N.J.

[73] Assignee: Foster Wheeler Energy Corporation, Livingston, N.J.

[22] Filed: May 23, 1974

[21] Appl. No.: 472,556

[52] U.S. Cl. ..... 44/2

[51] Int. Cl.[2] ..... C10L 5/00

[58] Field of Search ..... 44/2, 11–13; 241/23

[56] References Cited

UNITED STATES PATENTS 1,481,627 2/1924 Smith ..... 44/11

1,817,228 8/1931 Bliss ..... 44/2

*Primary Examiner*—Carl F. Dees

*Attorney, Agent, or Firm*—Marvin A. Naigur; John E. Wilson

[57] ABSTRACT

By product fines produced during the reduction of coal are conducted to an input of an inert gas generator. The by-product fines are burned forming a portion of the fuel needed to produce the inert gas, which gas is used to convey and dry the reduced coal in storage.

6 Claims, 2 Drawing Figures

COAL PROCESSING SYSTEM

BACKGROUND OF THE INVENTION

The invention herein relates to a system for reducing and storing combustible materials for use in subsequent processes. This system is particularly related to the reduction of feed coal for use in a subsequent coal gasification process.

A number of reducing systems presently available include feeders, mills, mechanical separators and circulating apparatus as well as inert gas generating means for supplying a medium incapable of supporting combustion, for carrying the reduced combustibles.

Some of the disadvantages of systems of this sort include the inordinate amounts of equipment necessary for circulating the inert gas, large amounts of auxiliary fuel for generating the inert gas and expensive separating means for eliminating fuel fines from the gas stream. Such systems may require bag filters and the like which are expensive to incorporate into a system and require constant maintenance which may affect the overall efficiency of the system.

A simplier system has been devised which eliminates many of the problems associated with separating fuel fines from gas streams and systems of the kind described herein.

It is therefore an object of the present invention to provide a system which eliminates the need for secondary filtering means for the separation of fuel fines from gas streams of the kind described herein.

It is another object of the present invention to utilize the fuel fines as an auxiliary fuel in an inert gas generator associated with systems of the kind described herein.

It is yet another object of the present invention to increase the efficiency of reducing and storage of combustibles, especially coal for subsequent gasification processes.

SUMMARY OF THE INVENTION

There has been provided apparatus for connecting combustible materials to a selected size and moisture content and discharging same for use thereafter, including means for reducing the combustibles, mechanical separator means, for receiving said reduced material in a stream of gas and separating all but fines from the gas stream. Means has been provided for circulating the gas and inert gas generating means in series with the aforementioned circulating means provides a non-combustible medium. The heated gas is also utilized for drying the reduced material to a selected moisture content. Means coupled to the separator introduces the stream of inert gas and fines to an input of the inert gas generating means for providing at least a portion of the fuel therefor, thereby eliminating the fines from the stream which are too small for mechanical separation.

For a better understanding of the present invention together with other and further objects thereof, reference is directed to the following description taken in connection with the accompanying drawings while its scope will be pointed out in the appended claims.

DESCRIPTION OF THE PREFERRED EMBODIMENTS

Figures 1, 2:
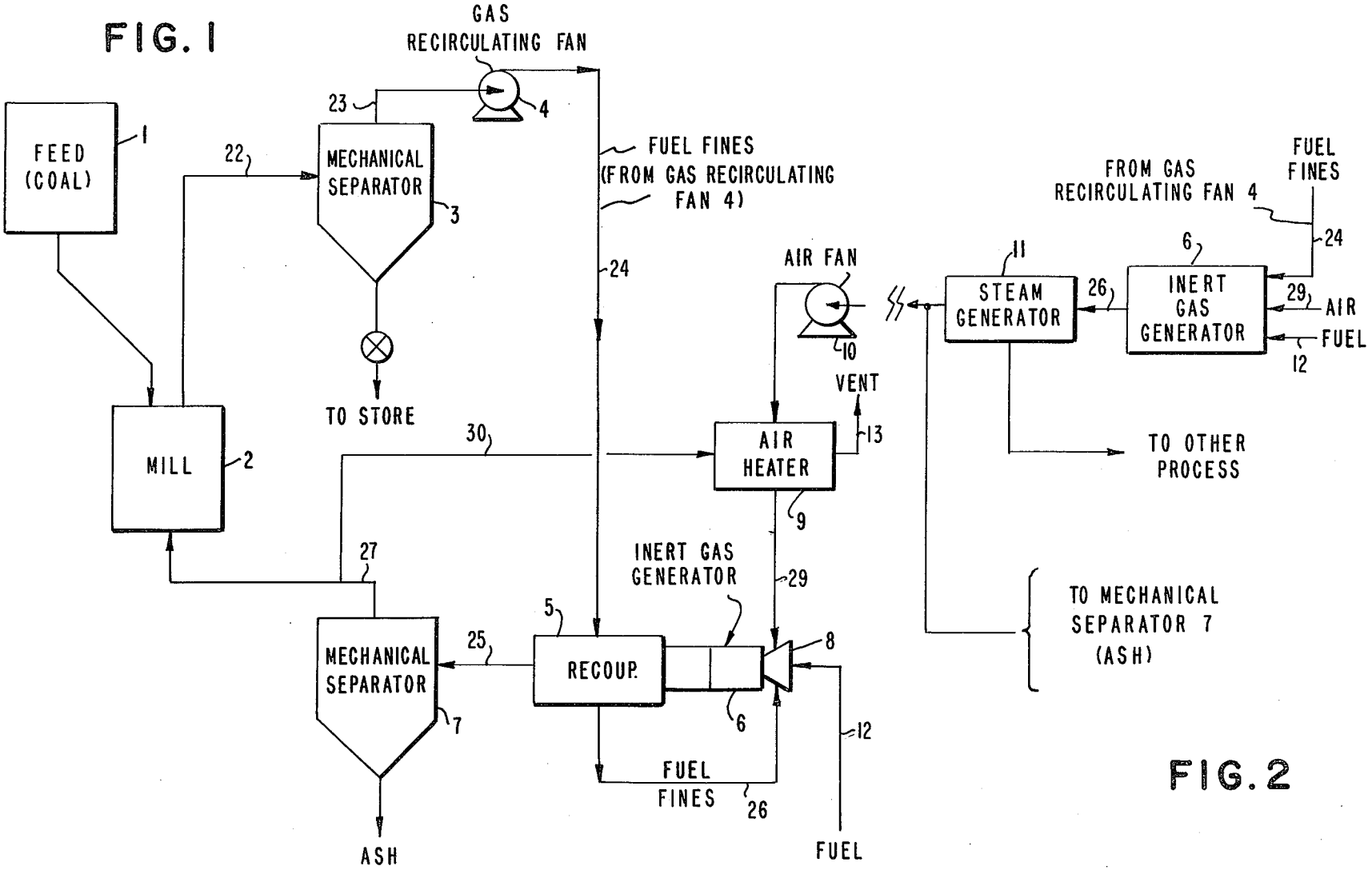
FIG. 1 is a block diagram illustrating the concept of the present invention.
FIG. 2 is a portion of the system illustrating an alternate embodiment of the present invention.

The present worldwide energy problem has lead to a resurgence in the utilization of coal as a fuel stock for power generating plants. Further because of the abundance of coal, there is great interest in proving efficient processes utilizing coal as the base material for producing a fuel gas, which may be used to produce clean natural gas substitutes. Along with the energy requirements, environmental restraints require that the utilization of coal be coupled with elimination of particulate discharges sometimes associated with the reduction and storage of coal feed stocks.

There are systems which effectively handle the reduction, separation, and storage of coal feed stock however, the systems are cumbersome and create certain environmental problems which the present invention seeks to remedy.

In referring to FIG. 1, there is shown a feed hopper 1 which receives and feeds, combustibles such as coal to an input of a reducing mill 2. The rate of feed is controlled by appropriate control means, (not shown). The mill 2 of a known kind reduces the coal to fine particule sizes necessary for subsequent processes.

The coal is delivered over conduit 21 to a mechanical separator 3 by a stream of inert gas is circulated. A circulating fan 4 which stream carries the reduced coal through the system as shall be explained below. The gas and reduced feed are provided at the input end 22 of the mechanical separator 3 which is designed to eliminate and separate most of the reduced material for storage as illustrated in the diagram. However, certain fine particles are carried beyond the mechanical separator into the remaining portion of the system. In previous systems, this material might be vented to the atmosphere which under present environmental circumstances is not permissible, or auxiliary separating means might be provided for trapping the extremely fine fuel particles remaining in the stream. This latter method has proven effective but sometimes reduces the efficiency of the system in terms of operating costs and down time due to the fact that filters which are capable of eliminating these fine particles must be constantly emptied and maintained.

The present invention directs unseparated fines and inert gas over output line 23 of the mechanical separator 3 through the gas circulating fan 4 line 24, recipuration unit 5 and line 25 for input to fuel inlet 8 of an inert gas generator 6. The fuel fines present in the inert gas stream may therefore be burned as an auxiliary fuel for generating the inert gas and thereby eliminate the fines from the gas stream and increase the efficiency of the system by utilizing a fuel source which would otherwise be wasted.

In the first embodiment of the present invention (FIG. 1), the output of the circulating fan 4 is directed through the recuperation unit 5 which is placed at the output of the inert gas generator 6. The recuperator 5 is basically a heat exchanger which preheats the gas stream before entry into the input 8 of the inert gas generator 6. Furthermore, the output of the inert gas generator 6 is generally too hot for direct introduction into the main stream of the circulating conduits and must be cooled. The recuperator 5 therefore serves the function of cooling the output of the inert gas generator 6 to a selected temperature capable of providing sufficient heat for drying the combustibles and also preheat the gas and fuel fines before entry into the input 8 of the generator 6. Another fuel source 12 is shown to the input 8 of the generator 6 which may be any acceptable source, but probably will be fuel provided by subsequent gasification processes resulting from the gasification of the feed coal. An air heater 9 and air fan 10 provides a source of air for supporting the combustion in the gas generator 6 and is controlled by any suitable means not shown for providing just a sufficient amount of air to support combustion in the generator so that generally only inert gas is produced at the output thereof. The air heater 9 preheats the air for introduction into the input 8 of the generator 6 over line 29 and may be a similar device to the recuperator 5.

The coal processing system in accordance with present invention is vented to atmosphere at 13 as illustrated so that there is no excess pressure buildup within the circuit defined by the reducing apparatus.

The output of the inert gas generator 6, through the recuperator 5, is coupled to a mechanical separator 7 over line 25 which separates ash from the exhaust of the generator 6. The separator 7 is capable of eliminating all but small amounts of ash from the present coal processing system and therefore it does not significantly affect the fuel stored or transmitted through the coal processing system and yet eliminates the need for expensive, and efficiency reducing, bag filters. The output 27 of the mechanical separator 7 is coupled to the mill 2 for supplying heat for drying the reduced coal and also for completing the circuit for carrying the reduced feed to the first mechanical separator 3 as previously described. Further, a portion of the inert gas is routed over line 30 to air heater 9 which as previously mentioned is vented at 13.

In a second embodiment of the present invention illustrated in FIG. 2, the inert gas generator 6 receives air and fuel as previously noted and also receives the fuel fines from the output of the mechanical separator 3. The output of the gas generator 6 is similarly coupled to the separator 7. However, in the second embodiment of the coal processing system illustrated in FIG. 2, the heat provided by the exhaust of the inert gas generator 6 is conveyed over line 26 to a steam generator 11 for the generation of steam for other processes associated with the gasification of the fuel being reduced. A portion of the steam so produced may be utilized to provide preheat to the gas stream carrying the fuel fines to the inert gas generator as well as for producing power for the process described herein or other processes so as to maximize or optimize the efficiency and utilization of available power in the system.

From the previous description, it is clear that burning the available fuel fines rather than separation and storage thereof provides a source of fuel which is economical since it eliminates a difficult process and utilizes an energy source wasted more often than not.

There has therefore been provided an improved system for reducing combustible raw materials to a product of a selected particle size which efficiently utilizes difficult to separate fuel fines as an auxiliary fuel in the process.

What is claimed is:

1. A system for handling combustible raw materials and reducing said raw materials to product and by-product fines of selected particle sizes comprising:

a reducing mill for reducing the raw materials and producing an outlet stream of said product and by-product fines, a fuel fired generator coupled in closed circuit relationship with said reducing mill for producing an inert gaseous medium for carrying said product and by-product from said reducing mill;

means in flow communication with said gas generator for circulating said gaseous medium; separator means in flow communication with said reducing mill for receiving said outlet stream of said mill and separating said product and by-product fines;

conduit means coupled to said separator means for directing by-product to said inert gas generator for combustion therein such that by-product fines provide a portion of the fuel necessary for producing said gaseous medium, and eliminating said by-product fines.

2. The system defined in claim 1 further comprising; an outlet of said gas generator, an ash separator; said ash separator being connected with and inflow communication with said outlet of said inert gas generator wherein ash produced during the production of said inert gaseous medium flows through said ash separator to be separated from the inert gaseous medium.

3. The system defined in claim 1 further comprising; an air heater connected with said mechanical separator to receive inert gaseous medium, said air heater having an inlet for air and connected to said gas generator so that said air heater indirectly transfers heat from said inert gaseous medium to said air to heat said air for said inert gas separator.

4. The system as described in claim 3 further comprising: a fan coupled to the inlet of the air heater for driving the air into said air heater and a vent connected with said air heater for venting a portion of said inert gaseous medium to the surrounding atmosphere.

5. The system defined in claim 1 further comprising a recuperator connected in flow communication with an outlet of said inert gas generator, said recuperator coupled in flow communication with said conduit means carrying the by-product to the generator, said by-product receiving heat by indirect heat exchange with hot inert gaseous medium produced by said inert gas generator, before introduction into said inert gas generator.

6. The system as defined in claim 1 further comprising; a steam generator coupled in flow communication with an outlet of said inert gas generator, said steam generator producing steam by passing working fluid in indirect heat exchange relation with said inert gaseous medium.

* * * * *